9/6/77 XR 4,047,181

United States Patent [19]

Hoople

[11] 4,047,181

[45] Sept. 6, 1977

[54] OMNIDIRECTIONAL ANTENNA

[75] Inventor: Gary R. Hoople, San Jose, Calif.

[73] Assignee: The United States of America as represented by the Secretary of the Navy, Washington, D.C.

[21] Appl. No.: 686,868

[22] Filed: May 17, 1976

[51] Int. Cl.[2] ..... H01Q 1/28

[52] U.S. Cl. ..... 343/789; 343/872

[58] Field of Search ..... 343/789, 794, 795

[56] References Cited

U.S. PATENT DOCUMENTS 3,713,167 1/1973 David ..... 343/789

*Primary Examiner*—Saxfield Chatmon, Jr.
*Assistant Examiner*—David K. Moore
*Attorney, Agent, or Firm*—R. S. Sciascia; Charles D. B. Curry; Elliott N. Kramsky

[57] ABSTRACT

A thin omnidirectional antenna suitable for mounting and operation flush to a ground plane. A flat metal probe is sandwiched between a pair of dielectric vanes which are enclosed in turn by a pair of metallic T-guides within a radiating cavity. The design achieves resonance for efficient radiation within an electrically small cavity.

10 Claims, 6 Drawing Figures

OMNIDIRECTIONAL ANTENNA

BACKGROUND OF THE INVENTION

1. Field of the Invention

The present invention relates to the transmission of electromagnetic energy. In particular, it relates to radiating antennas of cavity design.

2. Description of the Prior Art

Previous design art for thin, electrically small antennas has included the use of active elements (transitors) and dielectric or ferrite materials. Active devices require an external source of energy and are susceptible to environmental changes, such as temperature. Dielectric or ferrite materials tend to decrease radiation efficiency.

The theoretical normal gain and efficiency limitations of electrically small antennas have been defined by Harrington in *Time Harmonic Fields* (McGraw Hill, 1961). D. Rhodes in the *IEEE Transactions on Antennas and Propagation,* May, 1972, pages 318–325, has theoretically defined the limitations of frequency bandwidth.

The present invention achieves the maximum limits of gain and bandwidth as theoretically derived above by providing an electrically small rectangular cavity having a T-guide therein.

SUMMARY OF THE INVENTION

Briefly, the present invention comprises a flat metal probe sandwiched between a pair of dielectric vanes which are enclosed in turn by a pair of metallic T-guides within an electrically small cavity.

STATEMENT OF THE OBJECTS OF THE INVENTION

An object of this invention is to provide a thin cavity antenna capable of flush mounting.

Another object of this invention is to achieve the above object while achieving omnidirectional radiation.

Yet another object of this invention is to achieve an electrically small antenna which achieves efficient radiation.

Other objects, features and advantages will appear in the subsequent detailed description wherein like numerals throughout the figures indicate like parts.

DESCRIPTION OF THE PREFERRED EMBODIMENT

Figure 1:
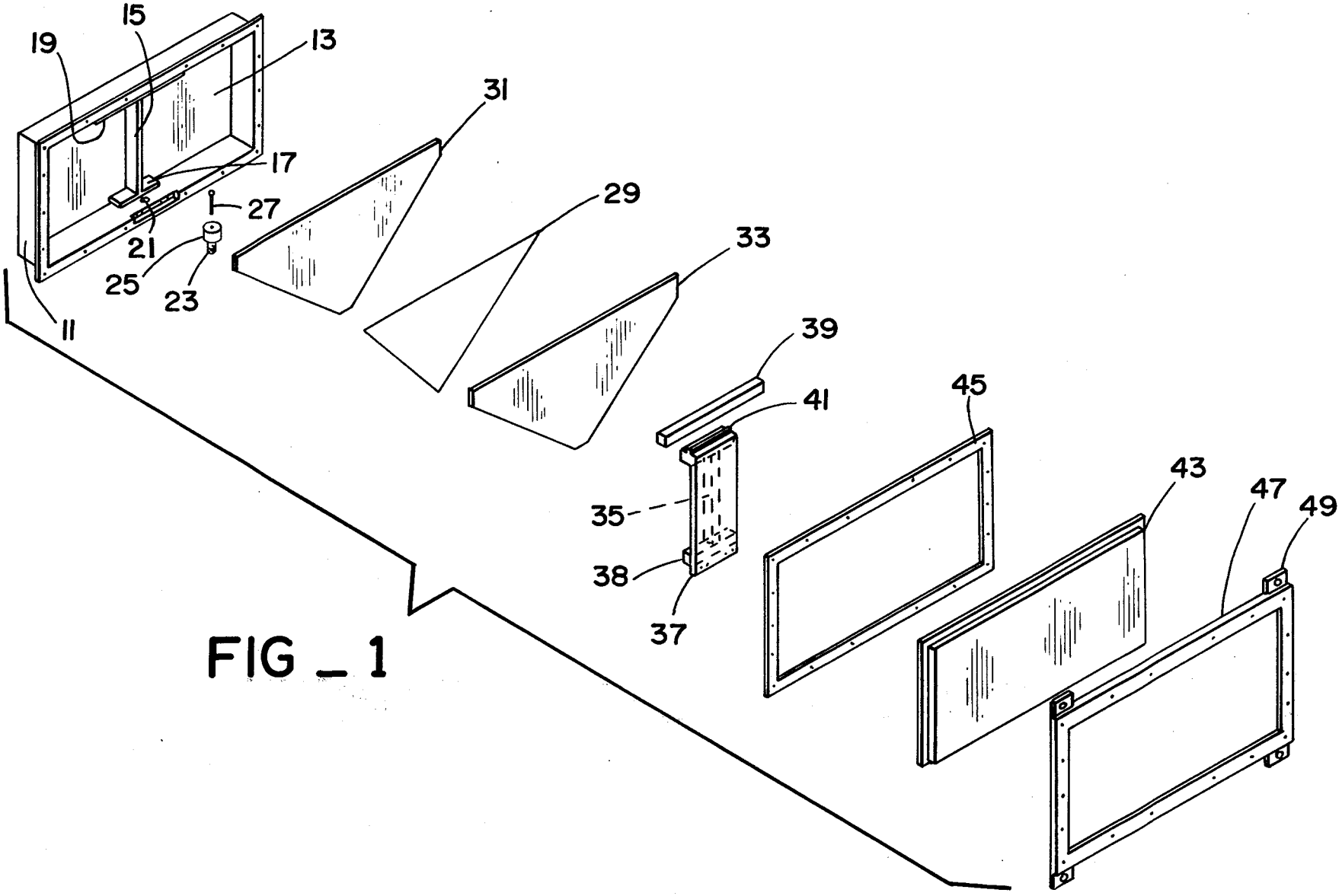
FIG. 1 is a partially exploded view of the present invention.

Referring now to FIG. 1, there is presented in exploded perspective view the present invention. A rectangular cavity 11 forms the main body of the invention. The cavity 11 is enclosed on all sides and at rear wall 13 and is constructed wholly of electrically conductive material. A rear T-guide 15 is formed as part of the cavity 11. The rear T-guide 15 is flush to rear wall 13, terminating in bars 17 and 19.

An entry port 21 exists at the bottom of the cavity 11 to allow the entry and transfer of electromagnetic energy from a standard coaxial cable 23. A standard connector 25 commutes with the cavity 11, allowing the entry into the cavity 11 of a transfer stem 27. The stem 27 couples to a flat triangular probe 29 of suitable electrically conductive material by a standard interface to one side of the probe.

Probe 29 is sandwiched between a pair of quasi-triangular insulating vanes 31, 33, each of which is truncated at its vertices to ensure a flush fit against the interior walls of the cavity 11. The vanes 31, 33 are designed to overlap the edges of probe 29 to further electrical insulation from the interior of the cavity 11.

The probe 29 and vanes 31, 33 form a sandwich which is held in place by the forces of intimate contact with T-guide 15 at the rear of the combination and similar contact with forward T-guide 35 at the front of the combination. Forward T-guide 35 is formed as part of vane plate 37. Like the rear T-guide 15, forward T-guide 35 is of a height (measured from top to bottom) adjusted so that, in accordance with theoretical considerations to follow, energy traveling within cable 23 in a coaxial propagation mode will be transformed within cavity 11 first to a stripline mode then to resonance for a TE propagation mode. The bottom of forward T-guide 35 is coincident with I bar 38. Unlike rear T-guide 15, forward T-guide 35 is insulated at its top portion from the walls of cavity 11 by dielectric block 39. A retaining tray 41 exists at the top vane plate 37, facilitating the retention of dielectric block 39 in its preferred orientation.

In terms of antenna operation, dielectrics 31, 33 and 39 serve to insulate and electrically lengthen probe 29. Appropriate design and selection will allow the matching of the real part of cavity 11 impedance to the impedance of coaxial cable 23, commonly 50 ohms, for maximum power transfer. The real part of input impedance is also a direct function of the electrical length of probe 29. Efficient radiation of energy is achieved in the E plane by the non-insulation of the lower portion of vane plate 37. The lack of dielectric insulation prevents generation of a counterbalancing negative E vector in the E plane detracting from the positive E vector at the top of vane plate 37. The E vectors in the H plane emanating from vane plate 37 are oppositely directed and cancel each other.

Figure 2:
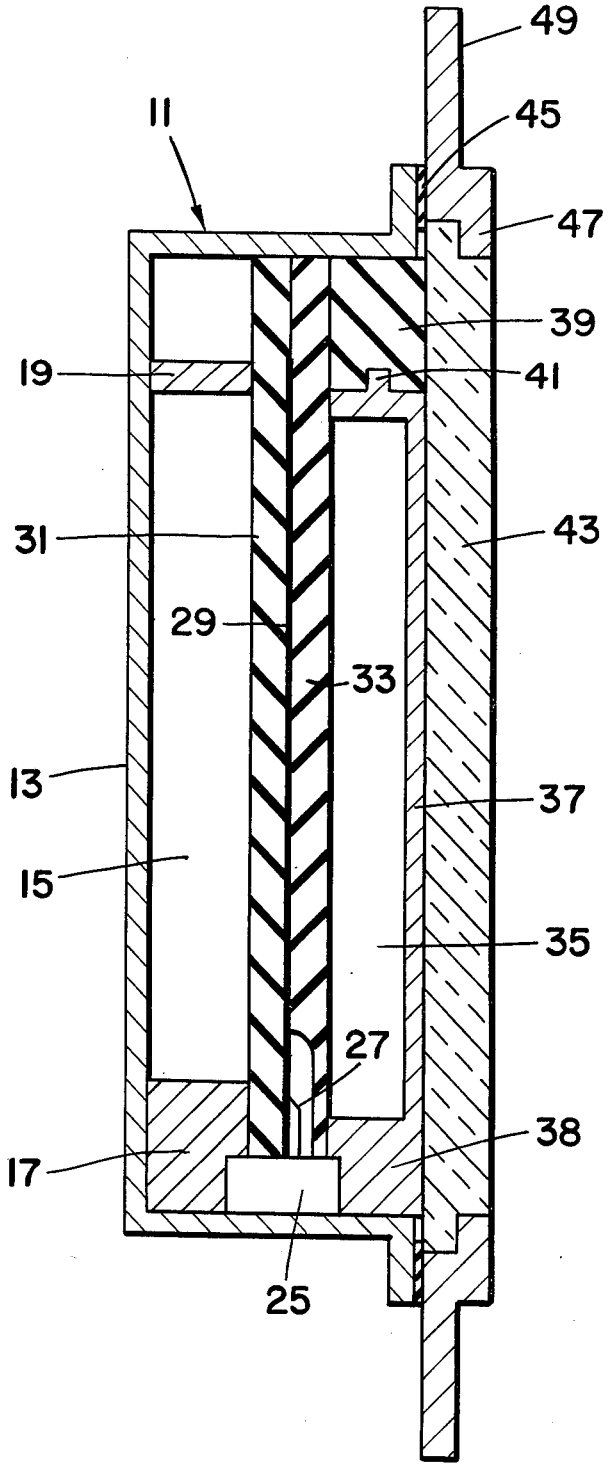
FIG. 2 is a side sectional view of the antenna body of the present invention.

A window 43 of suitable dielectric exists in the front of the antenna to provide a proper interface for the radiation of electromagnetic energy from the cavity 11 into free space. The window 43 is held in place and mounted to the cavity 11 by a conventional gasket 45 and cover 47 arrangement. Mounting holes 49 exist in the cavity to provide for the operational mounting of the antenna. FIG. 2, a side sectional view of an operational antenna according to the present invention, more clearly illustrates the operational configuration and the presence of the solid rear wall 13 of the cavity 11.

In order that the present invention may be better understood, a theoretical explanation relating to the achievement of resonance within cavity 11 will now be given. It is to be understood, however, that this theoretical explanation is given merely for the purpose of exposition and in order that the invention may be better appreciated. While this theoretical explanation is believed to be correct, it is not of necessity complete, nor does the operation of the invention depend upon its accuracy or otherwise.

Figure 3:
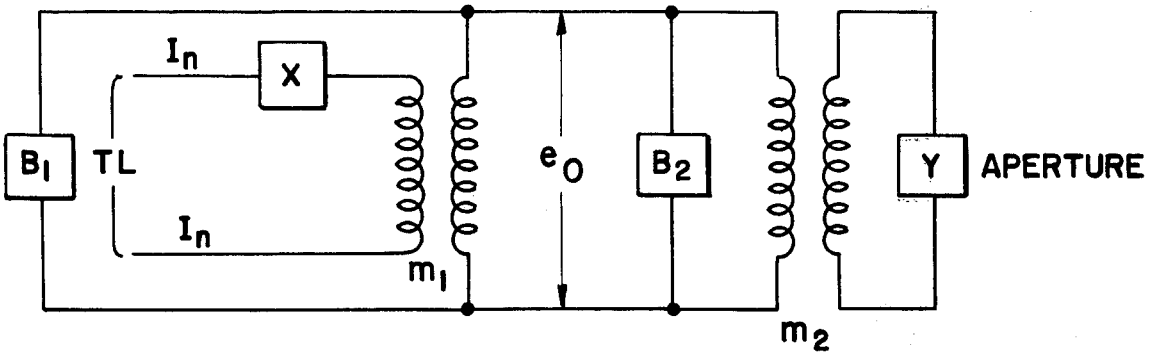
FIG. 3 is an equivalent circuit schematic representation of the operation of the present invention.

A schematic view of the equivalent circuit of the present invention is shown in FIG. 3. The coaxial transmission line from the source (not shown) is identified by the lines TL. The reactive components due to the combination of T-guides 15 and 35 and probe 29 are combined and denoted X. $M_1$ represents the inductive transfer of energy from probe 29 to radiating cavity 11. $B_1$ represents the susceptive component due to the short circuit formed by the back wall 13 of the cavity 11 while $B_2$ represents the susceptive component of the admittance due to the open circuit formed by the absence of conductors at the face of cavity 11. $M_2$ represents the transfer of energy from cavity mode to free space traveling wave mode through window 43 at the face of cavity 11.

It is known that $B_1$, the susceptive component of admittance, due to the short circuit formed by back wall 13, is inductive and that $B_2$, the corresponding component of admittance due to the open circuit at the face of cavity 11 is capacitive. The corresponding analytical expressions are:

$$B_1 = i/z_o \tan kd_1$$

$$B_2 = -i/z_o \text{cotan } kd_2$$

where $k = 2\pi\lambda$, $z_o$ is the internal characteristic impedance of the cavity, $d_1$ is the distance from the probe 29 to the back wall 13 and $d_2$ is the distance from the probe 29 to the window 43.

The reactive component of impedance introduced by the combined effects of T-guides 15 and 35 and probe 29 is inductive and may be expressed as:

$$X = (z_o/2I_n^2) \int\int J_s \cdot e_o \, ds$$

where $I_n$ is the input current (coaxial transmission line 23), $e_o$ is the dominant cavity mode vector (voltage vector in cavity), $J_s$ is the probe current vector modified by the split T-guide design to change the integral of the above expansion from normally capacitive to inductive, and $ds$ represents an infinitesimal element of the cross section of cavity 11 taken at $d_1 = d_2 = 0$ (i.e., at probe 29).

The expressions for $B_1$ and $B_2$ indicate that, as $d_1$ or $d_2$ is decreased (i.e., the thin cavity condition is approached), $B_1$ approaches zero and $B_2$ approaches infinity. Thus a very large capacitive element of impedance, $1/B_2$, is generated, preventing the transfer of energy to a free space traveling wave from the cavity. This large capacitive component will not be cancelled out by $1/B_1$, which becomes negligible for small $d_1$. However, according to the present inventive concept, an inductive component $1/X$ is placed in parallel with $B_2$ to negate the susceptive term and form a resonant cavity circuit. It has been found that the addition and careful design of the combined T-guides 15 and 35 and probe 29 allows the antenna to achieve the maximum limits of bandwidth and gain possible for an electrically small antenna defined by D. Rhodes in *IEEE Transactions on Antennas and Propagation,* May 1972, pages 318 through 325.

Figure 4:
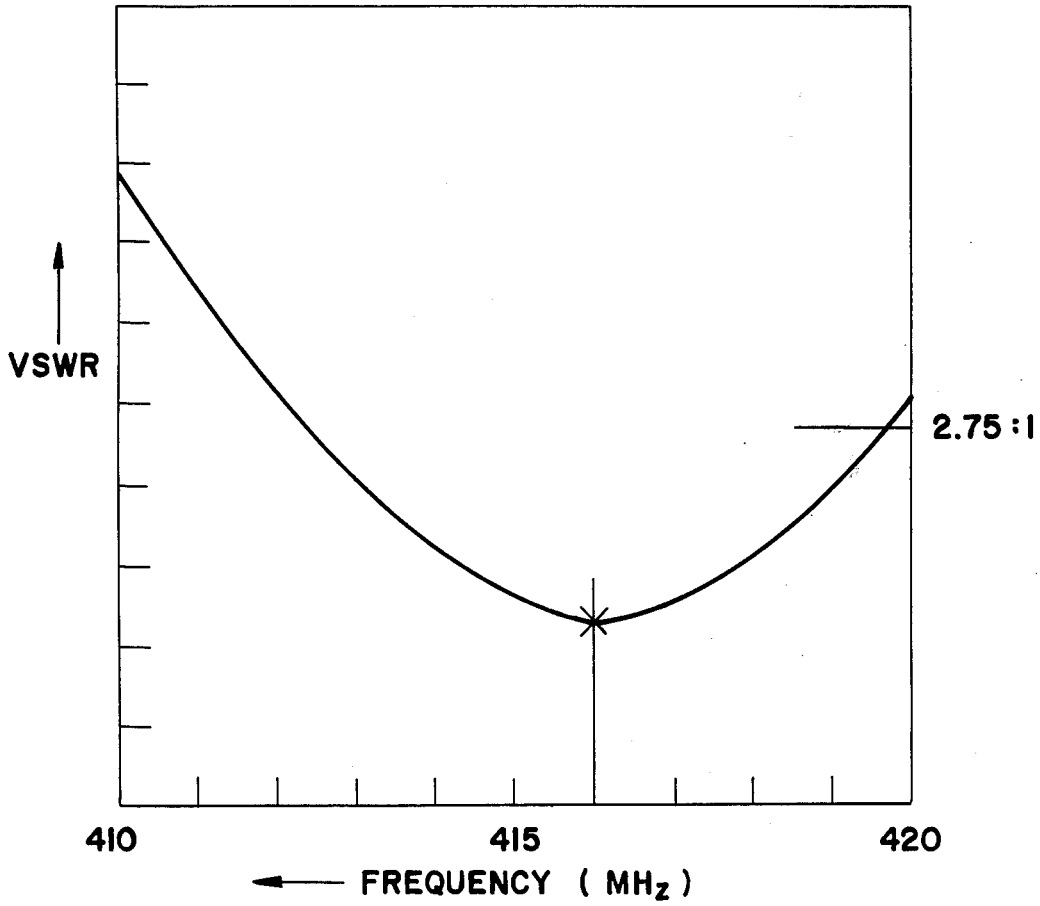
FIG. 4 is a chart of the impedance characteristics of the present invention.

FIG. 4 presents a chart in rectangular coordinates of the voltage standing wave characteristics of the present invention over the range of 410 MHz through 420 MHz of an electrically small antenna according to the present inventive concept. The significant design parameters of the antenna for which the data was generated included a depth ($d_1$ and $d_2$) of 0.016 free space wavelength and a cavity aperture face of 0.2 free space wavelength by 0.1 free space wavelength. The region of less than 2.75:1 VSWR (voltage standing wave ratio) results in an approximate 1 db loss and constitutes practical efficiency. In FIG. 4 this region covers a frequency range of 412.5 MHz to 419.5 MHz, thus showing maximum normal bandwidth for an electrically small antenna of this inventive concept.

Figure 5:
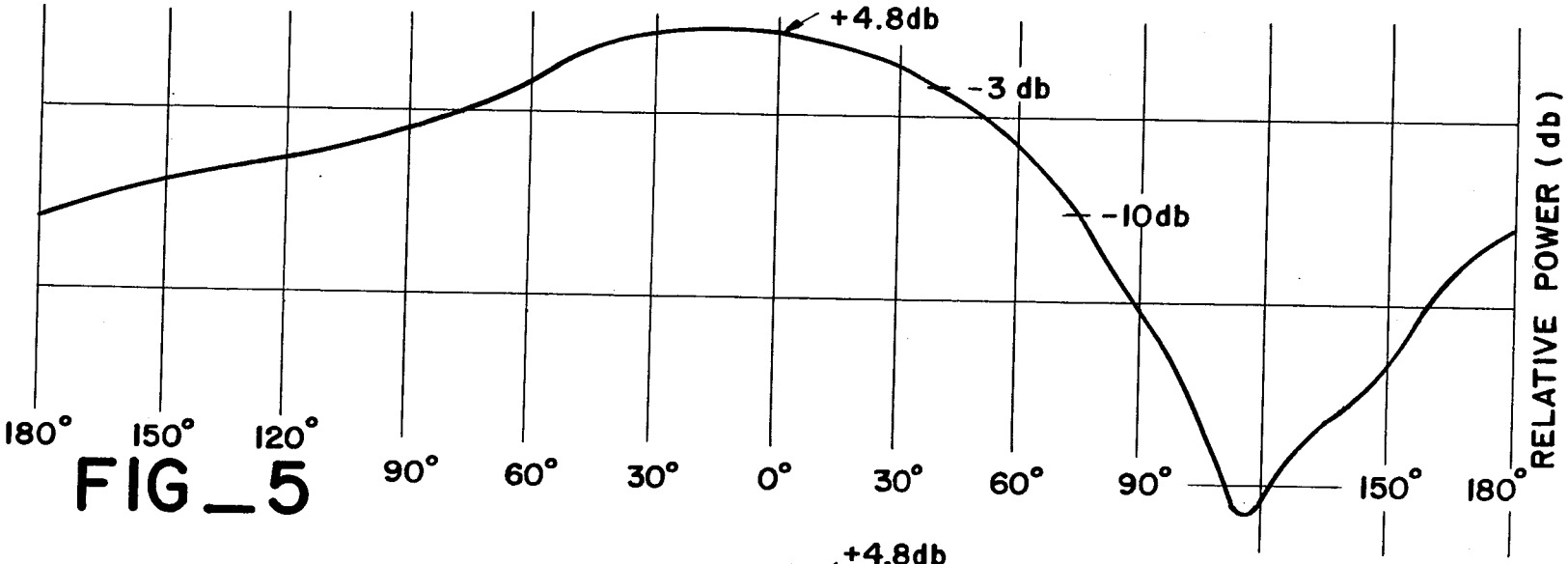
FIG. 5 presents an E plane radiation pattern of an antenna according to the present invention at the operating frequency of 416 MHz.
Figure 6:
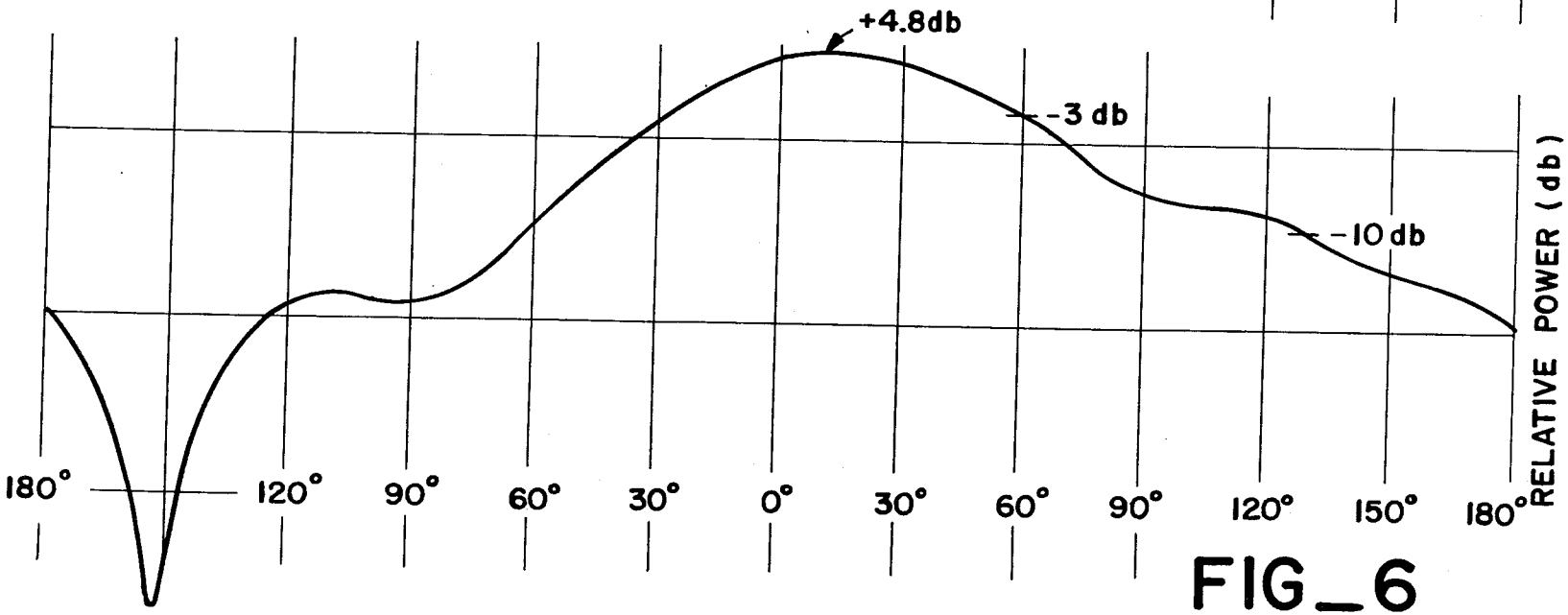
FIG. 6 presents an H plane radiation pattern of an antenna according to the present invention at the operating frequency of 416 MHz.

FIGS. 5 and 6 show E and H plane radiation patterns for an antenna according to the present inventive concept at an operating frequency of 416 MHz. Radiation patterns were measured in an anechoic chamber using a circular polarized field with isotropic gain reference established according to the gain substitution method. The patterns show wide beamwidths, characteristic of an omnidirectional antenna, of 100° and 244° at the 3db and 10db points respectively for the E plane and of 88° and 194° for the H plane. The patterns also show maximum efficient gain of 4.8db for an antenna of this inventive concept.

Thus it is seen that the present invention achieves an efficient thin cavity omnidirectional antenna of electrically small design.

What is claimed is:

1. In an antenna of the type having an input channel to receive electromagnetic energy transmitted by a coaxial cable and a cavity having a solid rear wall and having an aperture at its front to allow the radiation of said electromagnetic energy into free space wherein the improvement comprises:

a. a metallic probe positioned interior to said cavity;
b. said probe for electrical connection with said coaxial cable;
c. a first and a second T-guide each made of conductive material; and
d. said first T-guide located between said probe and said aperture and said second T-guide located between said probe and said rear wall.

2. An antenna as described in claim 1 wherein said antenna additionally comprises:

a. a first sheet of dielectric material located between said probe and said first T-guide to insulate said probe therefrom; and
b. a second sheet of dielectric material located between said probe and said second T-guide to insulate said probe therefrom.

3. An antenna as described in claim 2 including: a. a metallic vane plate; and
b. said first T-guide is formed and fixed on one side of said metallic vane plate.

4. An antenna as described in claim 3 wherein said second T-guide is formed with and extends the entire interior height of said solid rear wall of said cavity.

5. An antenna as described in claim 4 including:

a. a dielectric block; and
b. said dielectric block exists between the top of said vane plate and the interior of said cavity to electrically insulate said vane plate therefrom; and
c. the lower portion of said vane plate is in electrical contact with said cavity.

6. An antenna as described in claim 5 wherein said probe is flat and triangular in shape.

7. An antenna as described in claim 6 wherein both of said sheets of dielectric material are triangular having truncated vertices all of which contact the interior of the cavity.

8. An antenna as described in claim 7 wherein said input channel comprises:

a. a coupling for joining said coaxial cable to said cavity; and b. said cavity having an opening at the bottom to allow the entry of electromagnetic energy from said cable.

9. An antenna as described in claim 8 wherein said aperture has a predetermined width of 0.2 free space wavelength in the H plane.

10. An antenna as described in claim 9 wherein:

a. the internal depth of said cavity is 0.032 free space wavelength; and b. said aperture has a predetermined height of 0.1 free space wavelength in the E plane.

* * * * *